US009659691B2

(12) United States Patent
Ito et al.

(10) Patent No.: US 9,659,691 B2
(45) Date of Patent: May 23, 2017

(54) THIN-FILM THERMISTOR ELEMENT AND METHOD OF MANUFACTURING THE SAME

(71) Applicant: SEMITEC Corporation, Sumida-ku, Tokyo (JP)

(72) Inventors: Kenji Ito, Tokyo (JP); Tadashi Toyoda, Tokyo (JP)

(73) Assignee: SEMITEC CORPORATION, Tokyo (JP)

( * ) Notice: Subject to any disclaimer, the term of this patent is extended or adjusted under 35 U.S.C. 154(b) by 0 days.

(21) Appl. No.: 14/111,932

(22) PCT Filed: Jul. 9, 2013

(86) PCT No.: PCT/JP2013/068749
§ 371 (c)(1),
(2) Date: Oct. 15, 2013

(87) PCT Pub. No.: WO2014/010591
PCT Pub. Date: Jan. 16, 2014

(65) Prior Publication Data

US 2015/0170805 A1 Jun. 18, 2015

(30) Foreign Application Priority Data

Jul. 13, 2012 (JP) ..... 2012-157278

(51) Int. Cl.

| | |
|---|---|
| ***H01C 7/10*** | (2006.01) |
| ***H01C 7/04*** | (2006.01) |
| ***C22F 1/14*** | (2006.01) |
| ***H01C 17/075*** | (2006.01) |

(52) U.S. Cl.
CPC ..... *H01C 7/041* (2013.01); *C22F 1/14* (2013.01); *H01C 7/04* (2013.01); *H01C 17/075* (2013.01)

(58) Field of Classification Search
CPC ..... C07F 9/659; H01C 7/049; H01C 7/041; H01C 17/075
USPC ..... 338/22 R, 13
See application file for complete search history.

(56) References Cited

U.S. PATENT DOCUMENTS

| | | | | |
|---|---|---|---|---|
| 6,014,073 | A | 1/2000 | Torii et al. | |
| 7,240,409 | B2 * | 7/2007 | Sumi et al. | 29/25.35 |
| 7,323,806 | B2 * | 1/2008 | Shibata et al. | 310/358 |
| 8,084,925 | B2 * | 12/2011 | Shibata et al. | 310/358 |

(Continued)

FOREIGN PATENT DOCUMENTS

| | | | |
|---|---|---|---|
| CN | 1158163 | A | 8/1997 |
| CN | 102483978 | A | 5/2012 |

(Continued)

OTHER PUBLICATIONS

JP 07-201521, English machine translation, Aug. 1995.*

(Continued)

*Primary Examiner* — Kyung Lee
(74) *Attorney, Agent, or Firm* — Cantor Colburn LLP

(57) ABSTRACT

Provided is a thin-film thermistor element including a Si substrate 2, a thermistor thin film 5 formed on the Si substrate 2, and an electrode 3 made of platinum, an alloy thereof or the like and formed on, under or inside the thermistor thin film 5. The electrode 3 is formed from a film deposited containing oxygen and nitrogen and then crystallized by heat treatment.

10 Claims, 9 Drawing Sheets

(56) References Cited

U.S. PATENT DOCUMENTS

| | | | | |
|---|---|---|---|---|
| 8,514,050 | B1 | 8/2013 | Miura | |
| 2004/0183868 | A1* | 9/2004 | Sumi et al. | 347/71 |
| 2011/0175488 | A1* | 7/2011 | Shibata et al. | 310/319 |

FOREIGN PATENT DOCUMENTS

| | | | |
|---|---|---|---|
| JP | 354841 | H | 8/1991 |
| JP | 06061012 | A | 3/1994 |
| JP | 07201521 | A | 8/1995 |
| JP | 2000164404 | A | 6/2000 |
| JP | 2000348906 | A | 12/2000 |
| JP | 2003059704 | A | 2/2003 |
| JP | 2007-115938 | A | 5/2007 |
| JP | 2008244344 | A | 10/2008 |
| JP | 2008294288 | A | 12/2008 |
| JP | 4811316 | B2 | 9/2011 |

OTHER PUBLICATIONS

JP 2008-294288, English machine translation, Dec. 2008.*
Office Action for the Japanese application No. 2013-547042 dated Dec. 17, 2013. English translation attached.
Chinese First Office Action corresponding to Application No. 201380001059.6; Date of Mailing: Sep. 5, 2016, with English translation.
Chinese First Search Report corresponding to Application No. 2013800010596; Date of Mailing: Aug. 26, 2016.

* cited by examiner

THIN-FILM THERMISTOR ELEMENT AND METHOD OF MANUFACTURING THE SAME

This is the U.S. national stage of application No. PCT/JP2013/068749, filed on 09 Jul. 2013. Priority under 35 U.S.C. §119(a) and 36 U.S.C. §365(b) is claimed from Japanese Application No. 2012-157278, filed 13 Jul. 2012, the disclosure of which is also incorporated herein by reference

TECHNICAL FIELD

The present invention relates to a thin-film thermistor element used as a sensor such for example as a thermo sensor or an infrared sensor, and a method of manufacturing the thin-film thermistor element.

BACKGROUND ART

Thin-film thermistor elements have been used as thermo sensors or infrared sensors for devices such for example as information devices, communication devices, medical devices, household appliance devices, and automobile transmission devices. The thin-film thermistor element is a sintered compact of an oxide semiconductor having a large negative temperature coefficient. In general, in such a thin-film thermistor element, electrodes are formed on a substrate, then a thermistor thin film is formed thereon, and the resultant is heat-treated at a temperature of 1400° C. or below.

Here, in a case of forming electrodes made of platinum (Pt), an alloy thereof or the like directly on an underlayer provided in the substrate, the film deposition is performed with the substrate heated at 100° C. or above, and then the electrodes made of platinum (Pt), the alloy thereof or the like are formed by patterning with gas phase etching. In this case, a film deposition apparatus needs to have a mechanism to heat a substrate. In addition, since the gas phase etching does not use a corrosive gas, a general gas phase etching apparatus performs pattern formation by using a resist as a mask. In this process, there is a problem that the insulating underlayer, the thermistor thin film and the metal such as Pt tend to easily peel off each other due to weak adherence therebetween.

Hence, in order to obtain a strong adhesive strength between the underlayer and Pt or the like, an electrode is formed in a two layer structure including an adhesive layer made of a metal, an alloy or the like for obtaining the adhesive strength, and a conductive layer made of platinum, an alloy thereof or the like (Patent Literatures 1, 2 and 3).

As conventional techniques of this kind, there have been known ones described in the following literatures (Patent Literatures: 1. JP-A No. 2000-348906, 2. JP-B Hei 3-54841, 3. JP-A No. Hei 6-61012, 4. JP-B No. 4811316, 5.JP-A No. 2008-294288).

SUMMARY OF INVENTION

As illustrated in FIGS. 3 and 4, however, in the conventional manufacturing method, electrodes 3, 4 each including an adhesive layer 3B, 4B and a conductive layer 3A, 4A, and a thermistor thin film 5 are formed on a substrate 2 with an adhesive underlayer 2A, and then are heat-treated. Since the conductive layer made of Pt, the alloy thereof or the like is of a noble metal, the conductive layer has a problem of easily peeling off because the conductive layer has extremely weak adhesiveness to the underlayer and the thermistor thin film which are made of oxides.

For this reason, the thermistor thin film 5 formed on the electrodes 3, 4 peels off, and the peeling of the electrodes causes an increase in the resistance value. In the conventional method, an adhesive layer containing at least one of titanium and chrome is provided to improve the adhesiveness. However, the provision of the adhesive layer containing at least one of titanium and chrome produces another problem that the properties are deteriorated due to the progresses of reaction with the thermistor thin film and oxidizing of titanium or chrome.

The present invention has been made in view of the foregoing circumstances, and has an objective to provide a thin-film thermistor element and a method of manufacturing the thin-film thermistor element, which achieve a sufficient adhesive strength between a thermistor thin film and electrodes while maintaining the adhesive strength between a substrate and the electrodes.

In order to achieve the foregoing object, a thin-film thermistor element according to the present invention includes a base substance, a thermistor thin film formed on the base substance; and at least one pair of electrodes formed on, under or inside the thermistor thin film, and is characterized in that an electrode layer is deposited containing oxygen and nitrogen and then is crystallized by heat treatment.

In addition, a method of manufacturing a thin-film thermistor element according to the present invention is for forming a pair of electrodes by patterning on, under or inside a thermistor thin film formed on a base substance, and is characterized in that the method includes: a first step of depositing an electrode layer such that the electrode layer contains oxygen and nitrogen; a second step of forming a pair of electrodes by patterning; and a third step of crystallizing the electrode layer by heat treatment.

In these inventions, the electrode layer is formed containing oxygen and nitrogen and then is crystallized by the heat treatment. Thus, the concentration of the oxygen and nitrogen in the film of the conductive layer made of platinum (Pt), an alloy thereof or the like can be inhibited from varying even in the heat treatment after the film deposition for the one pair of electrodes and the thermistor thin film. Hence, the surface state of the electrode layer can be maintained in favorable conditions before and after the heat treatment. In contrast, in the case of an electrode layer not containing oxygen or nitrogen as in a conventional one, a rapid progress of the oxidizing and nitriding of the electrode layer in the heat treatment results in a phenomenon of peeling of the electrodes. In addition, an adhesive layer containing at least one of titanium and chrome, if provided, deteriorates the properties by reacting with the thermistor thin film.

In the case of the electrode layer of the present invention formed in the method of crystallizing a film by heat treatment after the film is deposited containing oxygen and nitrogen, the content of oxygen and nitrogen is inhibited from varying, so that the peeling of electrodes and the property deterioration can be inhibited.

Moreover, the thin-film thermistor element according to the present invention is characterized in that the electrode layer is deposited containing at least one of oxygen and nitrogen.

Further, the method of manufacturing a thin-film thermistor element according to the present invention is characterized in that the first step includes depositing the electrode layer with at least one of oxygen and nitrogen added. Then, after the deposition of the electrode layer, the one pair of electrodes are formed by patterning in the second step of patterning in a process such as etching.

These inventions enable the electrode layer to contain at least one of oxygen and nitrogen during the film deposition, and are capable of favorably crystallizing the electrode layer into grains in the crystalline state with <111> orientation in the third step using the method of crystallization by heat treatment.

In addition, the thin-film thermistor element according to the present invention is characterized in that the content of the at least one of oxygen and nitrogen in the second electrode layer is from 0.01% by weight to 4.9% by weight, both inclusive.

Moreover, the method of manufacturing a thin-film thermistor element according to the present invention is characterized in that the first step includes depositing the electrode layer with at least one of oxygen and nitrogen added.

In these inventions, the content of the at least one of oxygen and nitrogen is set to 0.01% by weight to 4.9% by weight, both inclusive, which makes it possible to crystallize the electrode layer into grains in the crystalline state with <111> orientation, and also inhibit a large increase in the resistance value due to the peeling of the electrode layer.

DESCRIPTION OF EMBODIMENTS

Figure 1:
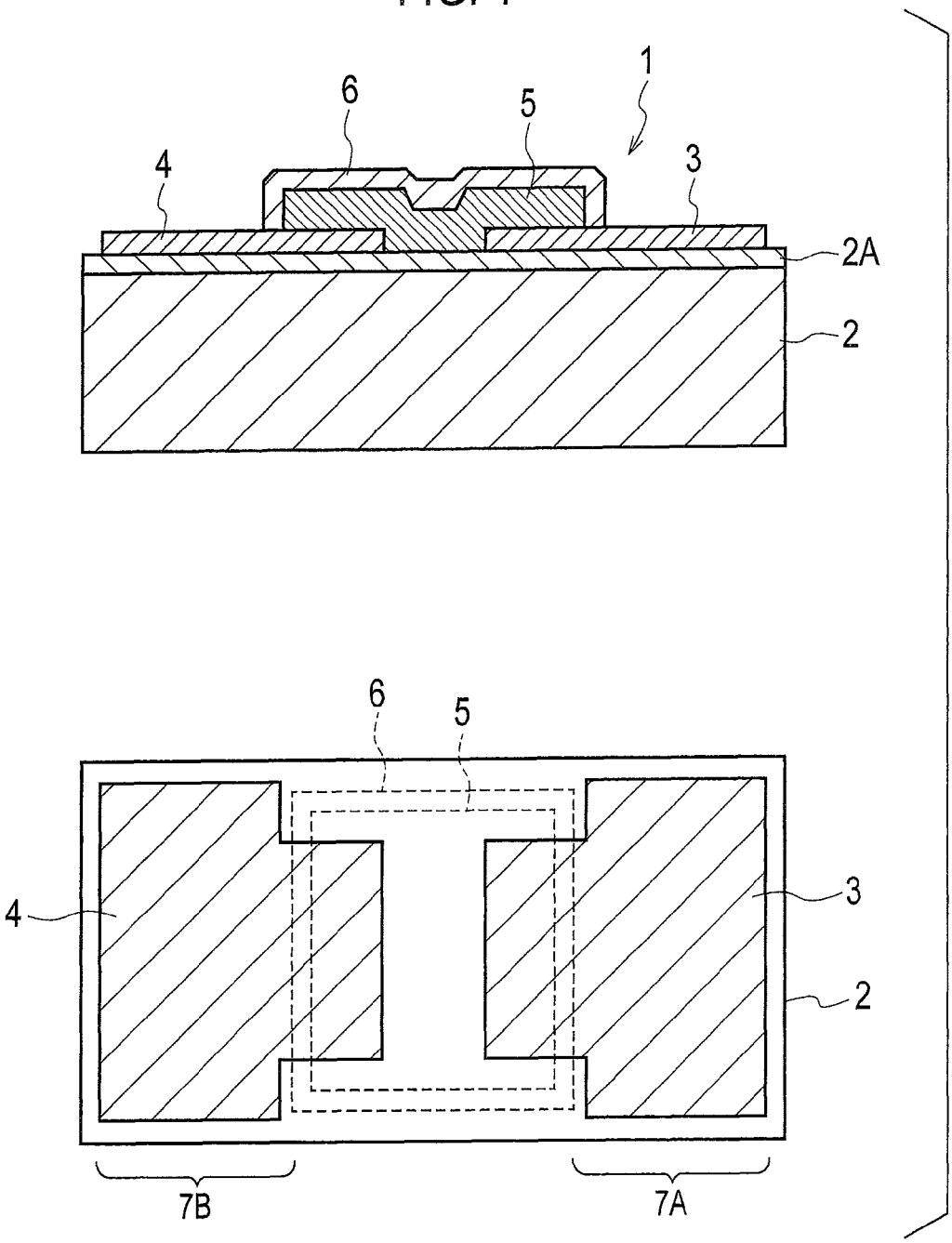
FIG. 1 is a cross sectional view and a plan view illustrating a thin-film thermistor element according to an embodiment of the present invention.
Figure 2:
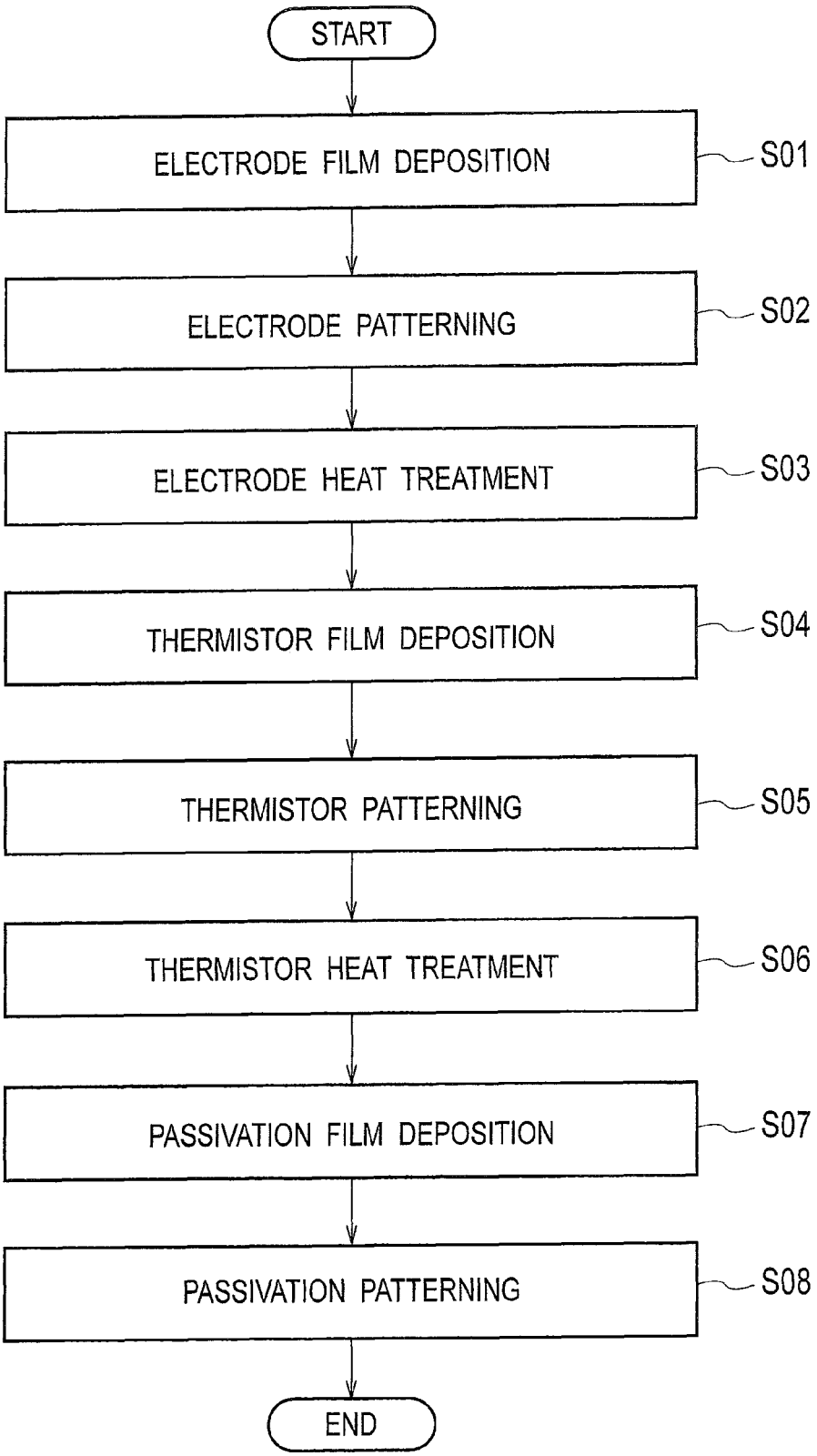
FIG. 2 is a flow diagram illustrating a method of manufacturing a thin-film thermistor element according to the embodiment of the present invention
Figure 3:
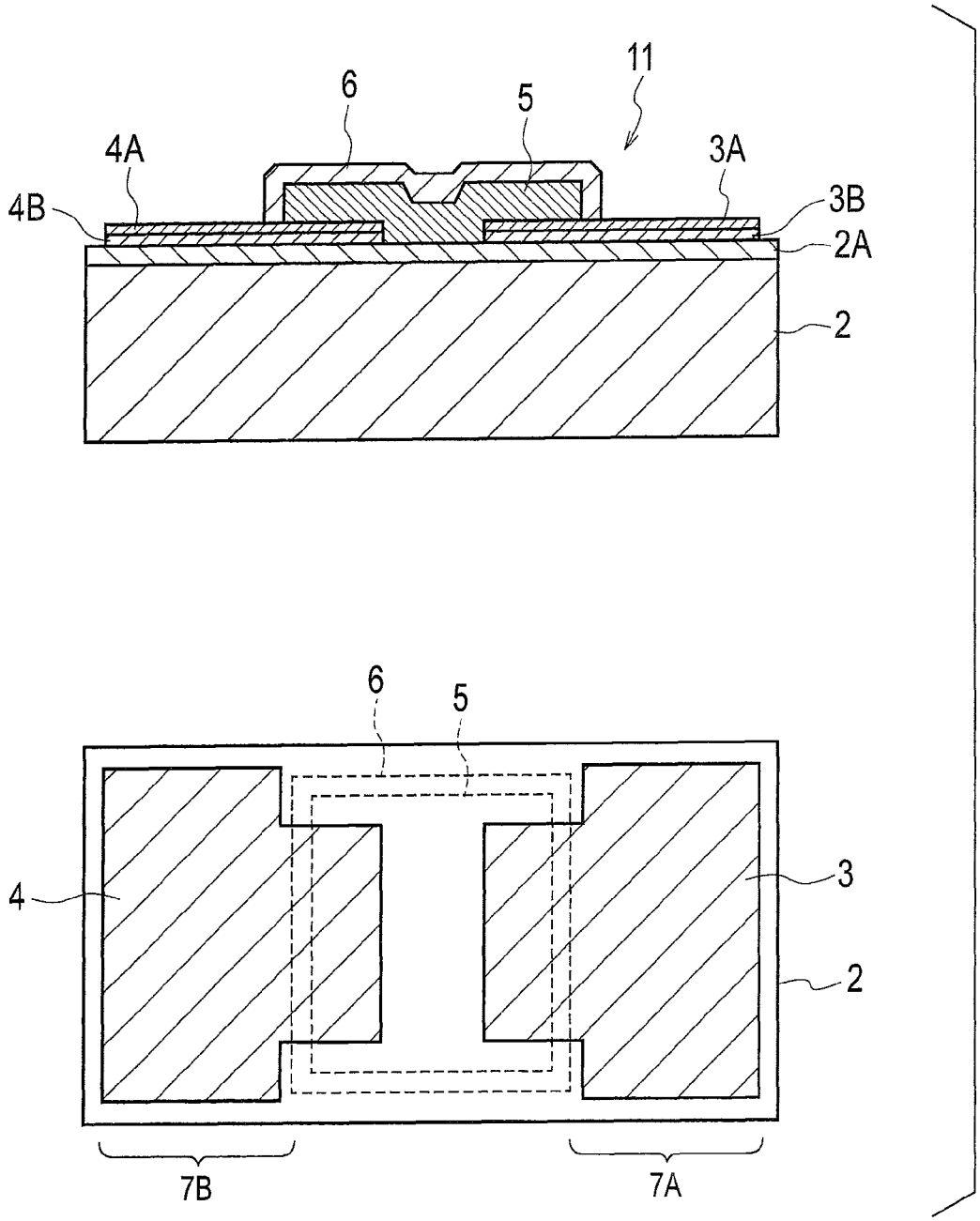
FIG. 3 is a cross sectional view and a plan view illustrating a thin-film thermistor element according to a conventional thin-film thermistor element.
Figure 4:
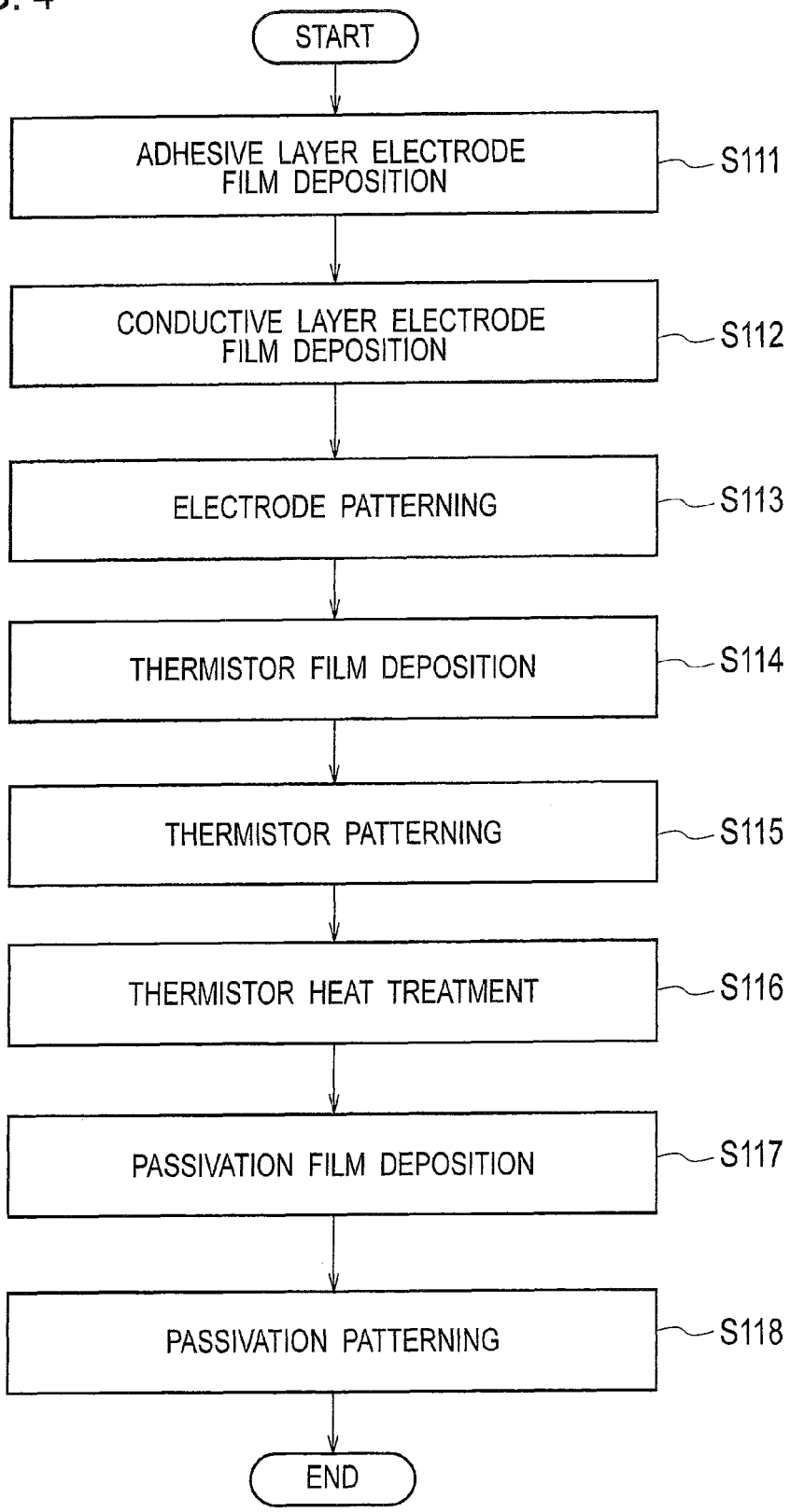
FIG. 4 is a flow diagram illustrating a method of manufacturing a thin-film thermistor element according to an embodiment of the conventional thin-film thermistor element.

With reference to FIGS. 1 and 2, description is provided for an embodiment of a thin-film thermistor element and a method of manufacturing a thin-film thermistor element according to the present invention. It should be noted that the drawings used in the following description are provided with the scale for constituent elements appropriately changed in order to make the constituent elements have recognizable sizes.

A thin-film thermistor element 1 according to the present embodiment is a sensor for temperature detection, for example, and includes an Si substrate (base substance) 2 having a surface in which a SiO2 layer 2A is formed as an underlayer; a pair of electrodes 3 and 4 formed by patterning on the SiO2 layer 2A; a thermistor thin film 5 formed on the SiO2 layer 2A, the electrode 3 and the electrode 4, and a passivation film 6 covering the thermistor thin film 5, as illustrated in FIGS. 1 and 2.

The above thermistor thin film is formed on the pair of the electrode 3 and the electrode 4.

The electrode 3 and the electrode 4 are formed on the SiO2 layer 2A. The pair of the electrode 3 and the electrode 4 are disposed opposed to each other at a certain interval therebetween. The pair of the electrode 3 and the electrode 4 include an electrode terminal portion 7A and an electrode terminal portion 7B, respectively, which extend to the outside of the thermistor thin film layer 5.

The pair of the electrode 3 and the electrode 4 are formed to contain at least one of oxygen and nitrogen during film deposition in the method described below. In this case, the content of at least one of oxygen and nitrogen is set to 0.01% by weight to 4.9% by weight, both inclusive, through heat treatment. Here, the content of at least one of oxygen and nitrogen means a total content of both oxygen and nitrogen if both of them are contained.

The thermistor thin film 5 is a composite metal oxide film made of a Mn—Co-based composite metal oxide (for example, a Mn3O4-Co3O4-based composite metal oxide) or a composite metal oxide (for example, a Mn3O4-Co3O4-Fe2O3-based composite metal oxide) being a Mn—Co-based composite metal oxide containing at least one of Ni, Fe, and Cu, and has a spinel crystal structure.

The passivation film 6 is made of a SiO2 film. Instead of the SiO2 film, another insulating film may be used such as a silicon nitride film (Si3N4), a silicon monoxide film (SiO), a glass film, a ceramic film, or a heat-resistant resin film as long as the film has insulating properties and is capable of blocking the external atmosphere.

Next, the method of manufacturing the thin-film thermistor element 1 according to the present embodiment is described.

As illustrated in FIG. 2, the method of manufacturing the thin-film thermistor element according to the present embodiment includes: a step (S01) of depositing a thin film made of platinum (Pt), an alloy thereof or the like on the SiO2 layer 2A in the Si substrate 2; a step (S02) of forming the pair of the electrode 3 and the electrode 4 by patterning after the film deposition; a step (S03) of heat-treating the electrode 3 and the electrode 4; a step (S04) of depositing the thermistor thin film 5 on the electrode 3 and the electrode 4; a step (S05) of patterning the thermistor thin film; a step (S06) of heat-treating the thermistor thin film 5; a step (S07) of depositing the passivation film 6, and a step (S08) of patterning the passivation film 6.

To begin with, a SiO2/Si substrate 2 is prepared in which an upper surface of the Si substrate 2 is thermally oxidized to form the SiO2 layer 2A with a film thickness of 0.5 μm, for example.

Then, there is included the first step (S01) of depositing an electrode layer made of platinum (Pt), an alloy thereof or the like.

The first step (S01) uses a high-frequency sputtering apparatus, a direct current sputtering apparatus or the like to deposit the electrode layer by using an atmospheric gas to which at least one of an oxygen gas and a nitrogen gas is added, while applying a sputtering power of 100 W to 2000 W under an atmospheric pressure of 100 mPa to 1330 mPa and at an argon gas flow rate of 10 sccm to 50 sccm. In this step, the gas concentration is set such that at least one of oxygen and nitrogen can be contained after the film deposition.

In the second step (S02), the electrode layer is formed by patterning with general photolithography or etching after the deposition of the electrode layer, and thereby the pair of the electrode 3 and the electrode 4 are obtained.

In the third step (S03), the pair of the electrode 3 and the electrode 4 can be crystallized into grains with a crystal structure in <111> orientation while containing the oxygen and the nitrogen, by using a method of crystallizing the pair of the electrode 3 and the electrode 4 by holding them for 1 to 10 hours in the atmosphere at a heat treatment temperature of 400° C. to 1000° C.

Instead, in the third step (S03), the pair of the electrode 3 and the electrode 4 can be crystallized into columns with a crystal structure in <111> orientation while containing the oxygen and the nitrogen, by using the method of crystallizing the pair of the electrode 3 and the electrode 4 by holding them for 1 to 10 hours in the atmosphere at a heat treatment temperature of 400° C. to 1000° C.

Otherwise, in the third step (S03), the pair of the electrode 3 and the electrode 4 can be crystallized into grains and columns with a crystal structure in <111> orientation while containing the oxygen and the nitrogen, by using the method of crystallizing the pair of the electrode 3 and the electrode 4 by holding them for 1 to 10 hours in the atmosphere at a heat treatment temperature of 400° C. to 1000° C.

Next, the step (S04) is performed in which the thermistor thin film 5 is deposited on the pair of the electrode 3 and the electrode 4.

Firstly, a composite metal oxide film to be the thermistor thin film 5 is deposited with a film thickness of 0.5 μm, for example, by sputtering. Here, it is preferable to set the composite metal oxide film to have a film thickness of 0.3 μm or larger, at which the film-thickness dependency of the volume resistivity becomes low.

In this step, the sputtering deposition conditions are set to, for example, an atmospheric pressure of 100 mPa to 1330 mPa, an argon gas flow rate of 10 sccm to 50 sccm, and the application of a sputtering power of 100 W to 2000 W. Here, a sputtering method may be employable in which sputtering is performed while the SiO2/Si substrate 2 where to form the thermistor thin film 5 is being heated. In this case, the temperature of the substrate is preferably set within a range of 200 to 800° C.

After the sputtering, the step (S05) of performing pattern formation by etching is performed. Then, the step (S06) of heat-treating the thermistor thin film 5 through predetermined heat treatment is performed. This heat treatment is performed for 1 to 24 hours in the atmosphere at a temperature of 400° C. to 1000° C.

Instead, the above heat treatment may be performed in an atmosphere of an inert gas such as an argon gas or a nitrogen gas, or any of these gases to which O2 in 0.1% by volume to 25% by volume is added.

Lastly, the processing advances to the step (S07) of depositing the passivation film 6. The SiO2 passivation film 6 to serve as a protection film, infrared absorbing film or the like is stacked on a first thermistor thin film 5A and a second thermistor thin film 5B. After the film deposition, the passivation film 6 is patterned (S08).

In this way, the thin-film thermistor element as a temperature detection sensor is fabricated.

According to the method of manufacturing the thin-film thermistor element, the pair of the electrode 3 and the electrode 4 are heat-treated after the film is deposited containing oxygen and nitrogen. In the case of the electrodes formed by the method in which the film is deposited containing oxygen and nitrogen and thereafter is crystallized by heat treatment, the content of oxygen and nitrogen due to heat is inhibited from varying in the heat treatment after the film deposition of the pair of the electrode 3 and the electrode 4 and the thermistor thin film 5.

Thus, since the content of oxygen and nitrogen in the pair of the electrode 3 and the electrode 4 is inhibited from varying after the heat treatment, it is possible to maintain favorable conditions by preventing occurrence of peeling, so that the adhesive strength between the Si substrate 2 and the pair of the electrode 3 and the electrode 4 can be maintained even after the heat treatment. In addition, since an adhesive layer containing at least one of titanium and chrome is not provided, the oxidized and nitrided states are stabilized, which contributes to the stabilization of thermistor properties.

In addition, the pair of the electrode 3 and the electrode 4 are made to contain at least one of oxygen and nitrogen during the film deposition, the conductive layer 3B can be crystallized into granular crystals (or columnar crystals or granular and columnar crystals) with the <111> orientation favorably containing the oxygen and nitrogen. In particular, since the content of at least one of oxygen and nitrogen in the pair of the electrode 3 and the electrode 4 is set to 0.1% by weight to 4.9% by weight, both inclusive, the pair of the electrode 3 and the electrode 4 can be crystallized into granular crystals (or columnar crystals or granular and columnar crystals) with the <111> orientation sufficiently containing the oxygen and nitrogen, and a large increase in the resistance value due to the peeling of the pair of the electrode 3 and the electrode 4 can be prevented.

Here, description is provided below for a reason why the content of at least one of oxygen and nitrogen in the pair of the electrode 3 and the electrode 4 is set to 0.1% by weight to 4.9% by weight, both inclusive.

Figure 11:
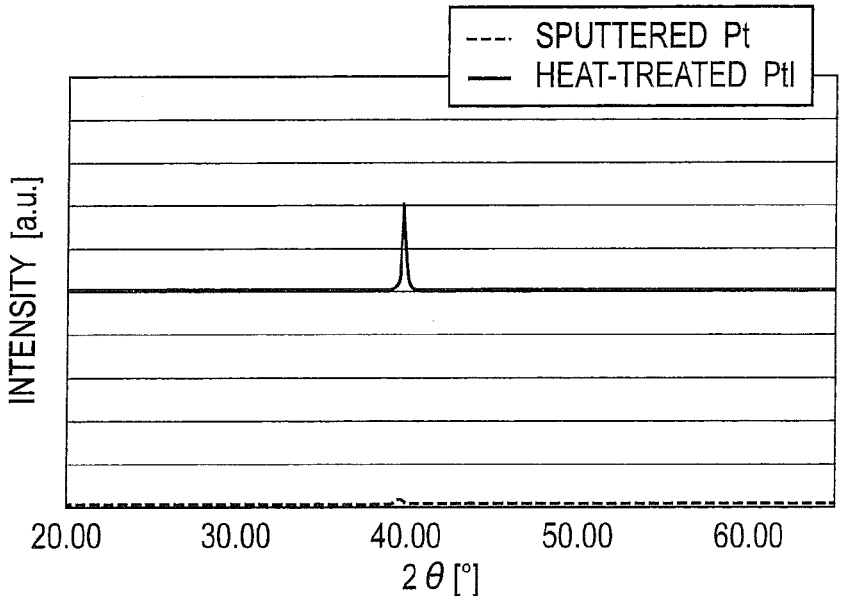
FIG. 11 is a graph of profiles obtained from the conductive layer of the thin-film thermistor element by thin film X-ray diffraction (thin film XRD: grazing incidence X-ray diffraction), which represents an effect of the present invention.

Specifically, in specific examples illustrated in FIG. 11, the oxygen content of a crystallized electrode is 1.3%, whereas the oxygen content of a non-crystallized electrode is 8.3%. The upper limit value of 4.9% by weight is approximately a middle value in this data, and the lower limit value is determined as 0.01% by weight because the film inevitably takes in oxygen even when the argon of the sputter gas is not made to contain oxygen.

Note that, in the case where the pair of the electrode 3 and the electrode 4 crystallized into grains (or columns crystals or grains and columns) with the <111> orientation contains an oxygen or nitrogen element in 5% by weight or more, the pair of the electrode 3 and the electrode 4 made of Pt, an alloy thereof or the like contain such an excessive amount of oxygen and nitrogen that the content tends to vary easily, and therefore it is difficult to obtain a sufficient effect of improving the adhesive strength. In addition, when the oxygen or nitrogen element is contained in more than 5% by weight, the resistance value as the electrode material largely increases. Thus, if the content is set within the above setting range, it is possible to maintain the sufficient adhesive strength between the thermistor thin film 5A and the electrode 3, to prevent the peeling, and thereby to also maintain favorable electric properties, even after a heat resistance test at 250° C. and a temperature cycling test with 100,000 cycles, for example, are conducted.

Patent Literatures 4, 5 mentioned above propose that the electrode layer made of platinum (Pt), an alloy thereof or the like is made amorphous. However, the heat resistance is 150° C. at most. The present invention produces an effect of improving the heat resistance.

It should be noted that the technical scope of the present invention is not limited to the foregoing embodiment, but may be altered in various ways without departing from the spirit of the present invention.

Figure 5:
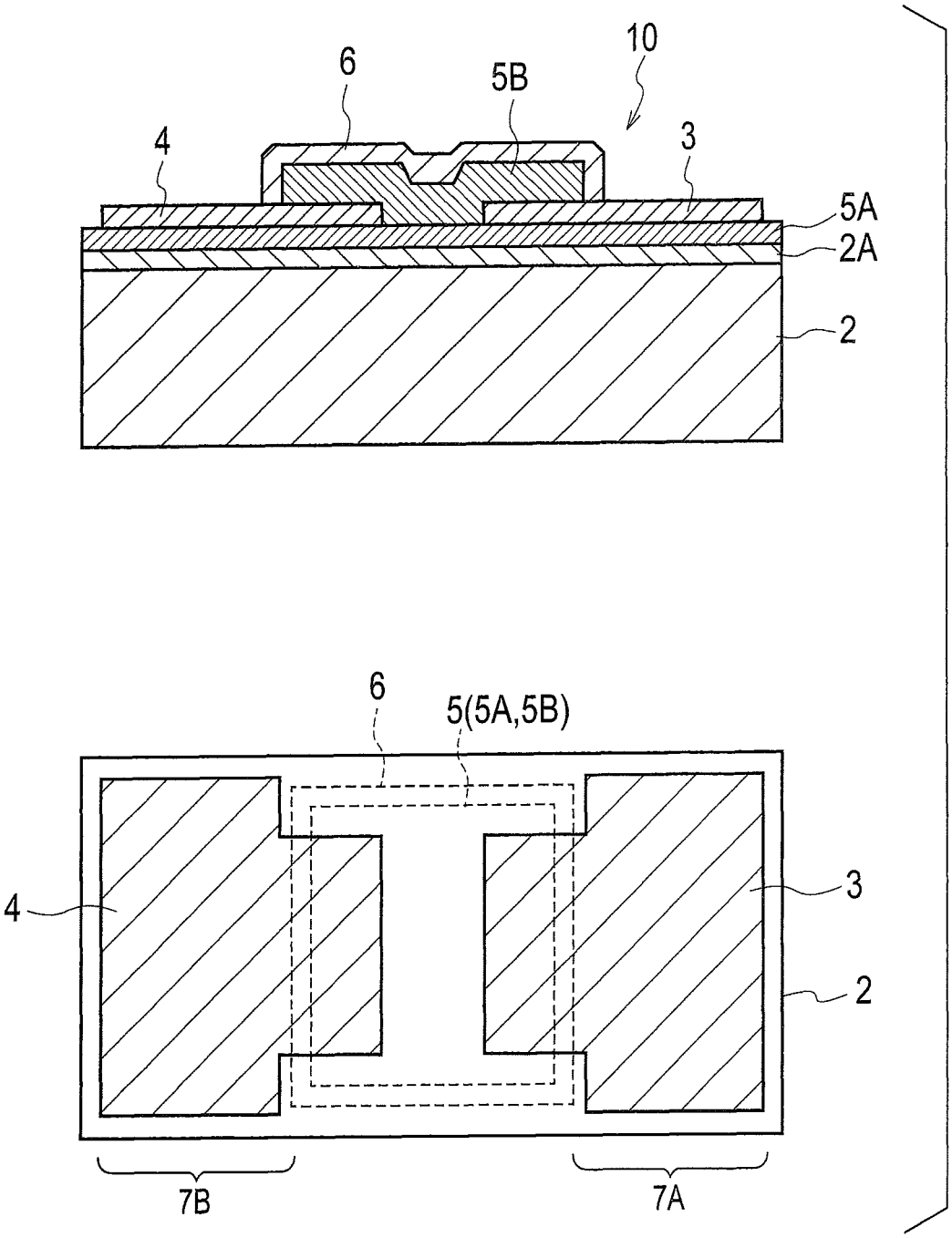
FIG. 5 is a cross sectional view and a plan view corresponding to FIG. 1 and illustrating another example that is a modified example of a thin-film thermistor element according to the embodiment of the present invention.

For instance, although the thermistor thin film 5A is deposited on the electrode 3 in the foregoing embodiment, a thin-film thermistor element 10 in another example of the foregoing embodiment may be formed in which a pair of an electrode 3 and an electrode 4 are formed inside a thermistor thin film 5A as illustrated in FIG. 5.

Figure 6:
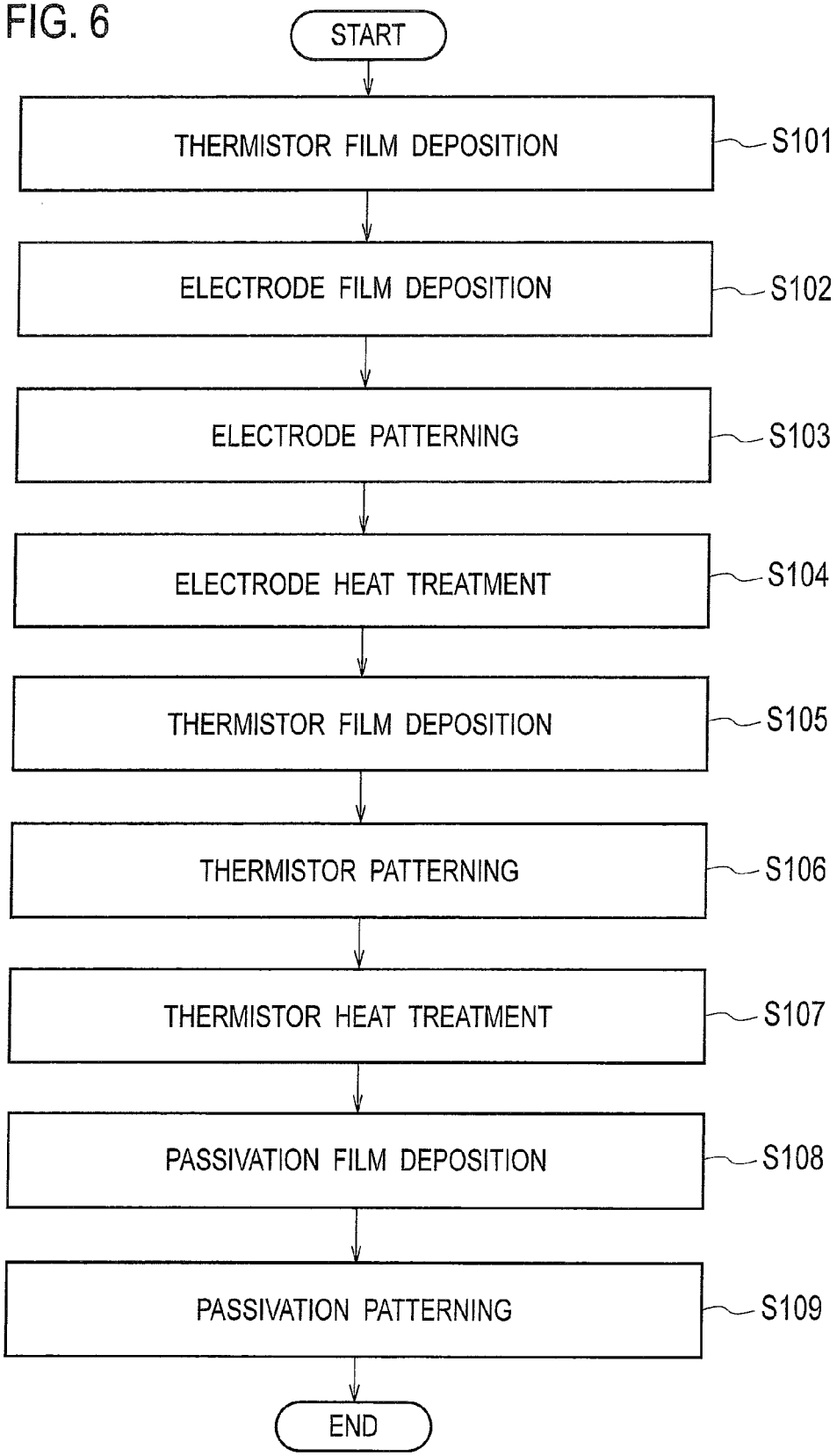
FIG. 6 is a flow diagram corresponding to FIG. 2 and illustrating a method of manufacturing a thin-film thermistor element according to the other example that is the modified example of the embodiment of the present invention.

As illustrated in FIG. 6, the manufacturing of the above thin-film thermistor element 10 includes: a step (S101) of depositing the thermistor thin film 5A on a SiO2 layer 2A in a Si substrate 2; a step (S102) of depositing a thin film made of platinum (Pt), an alloy thereof or the like; a step (S103) of forming the pair of the electrode 3 and the electrode 4 by patterning after the film deposition; a step (S104) of heat-treating the electrode 3 and the electrode 4 for crystallization; a step (S105) of depositing a thermistor thin film 5B on the pair of the electrode 3 and the electrode 4; a step (S106) of performing pattern formation of the thermistor thin film 5B; a step (S107) of heat-treating the thermistor thin film 5A and the thermistor thin film 5B; a step (S108) of depositing a passivation film 6 on these films; and a step (S109) of patterning the passivation film 6.

In addition, instead of the Si substrate 2 made of monocrystalline silicon which is a typical semiconductor, a semiconductor substrate made of germanium (Ge), gallium arsenide (GaAs), gallium arsenide phosphide (GaAsP), gallium nitride (GaN), silicon carbide (Sic), gallium phosphide (GaP) or the like may be used as another semiconductor material.

As a typical insulating substrate, an alumina (Al2O3) substrate or an insulating ceramic substrate made of silicon nitride (Si3N4), quartz (SiO2), aluminum nitride (AlN), or the like may be used.

Instead of the SiO2 layer 2A as the underlayer, a silicon nitride (Si3N4) film, a silicon monoxide film (SiO) or the like may be used.

Note that, in the case of an insulating substrate, the SiO2 layer 2A as the underlayer may be deposited not on the entire surface but only on a part of the surface, or may be unnecessary.

EXAMPLES

Figure 7:
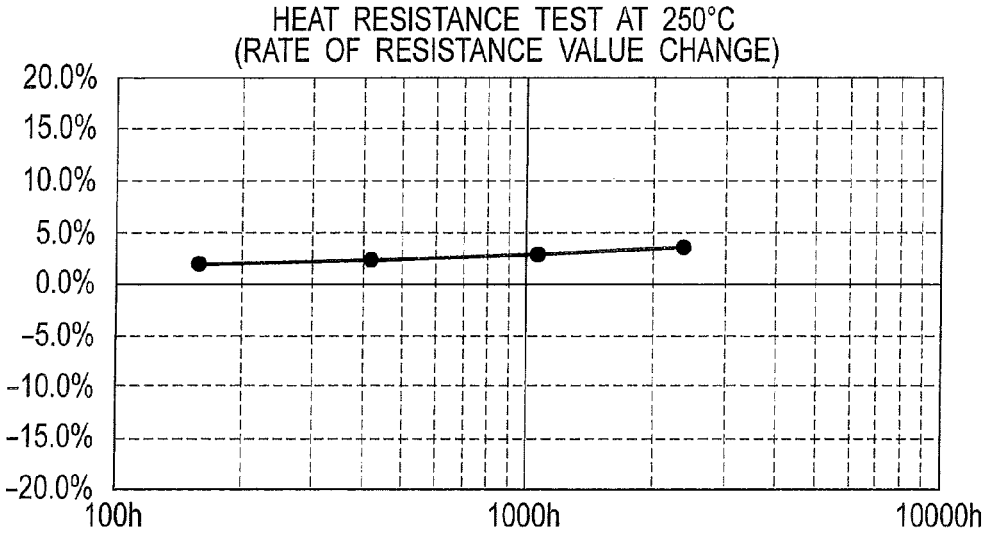
FIG. 7 is a graph illustrating a resistance value change in a heat resistance test at 250° C., which represents an effect of the present invention.
Figure 8:
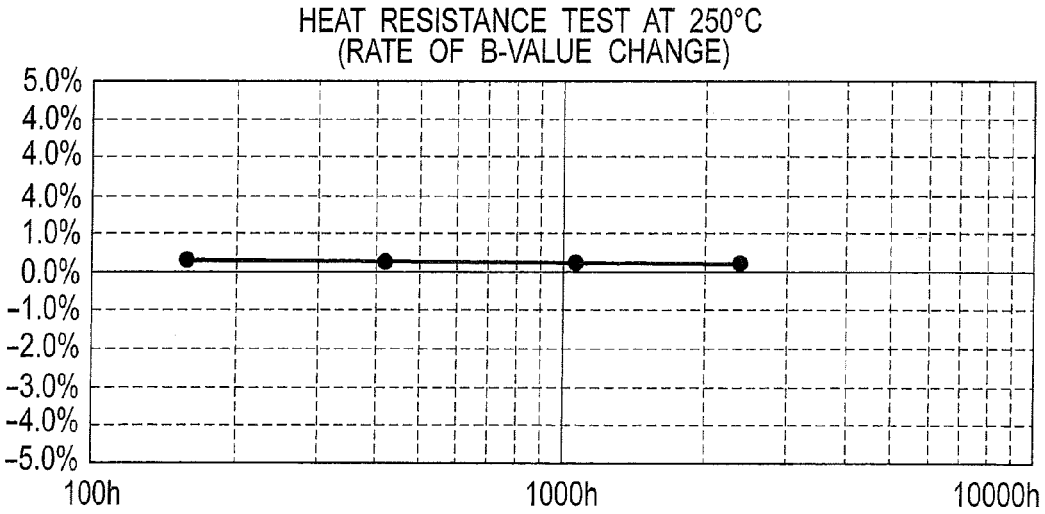
FIG. 8 is a graph illustrating a B-value change in the heat resistance test at 250° C., which represents an effect of the present invention.
Figure 9:
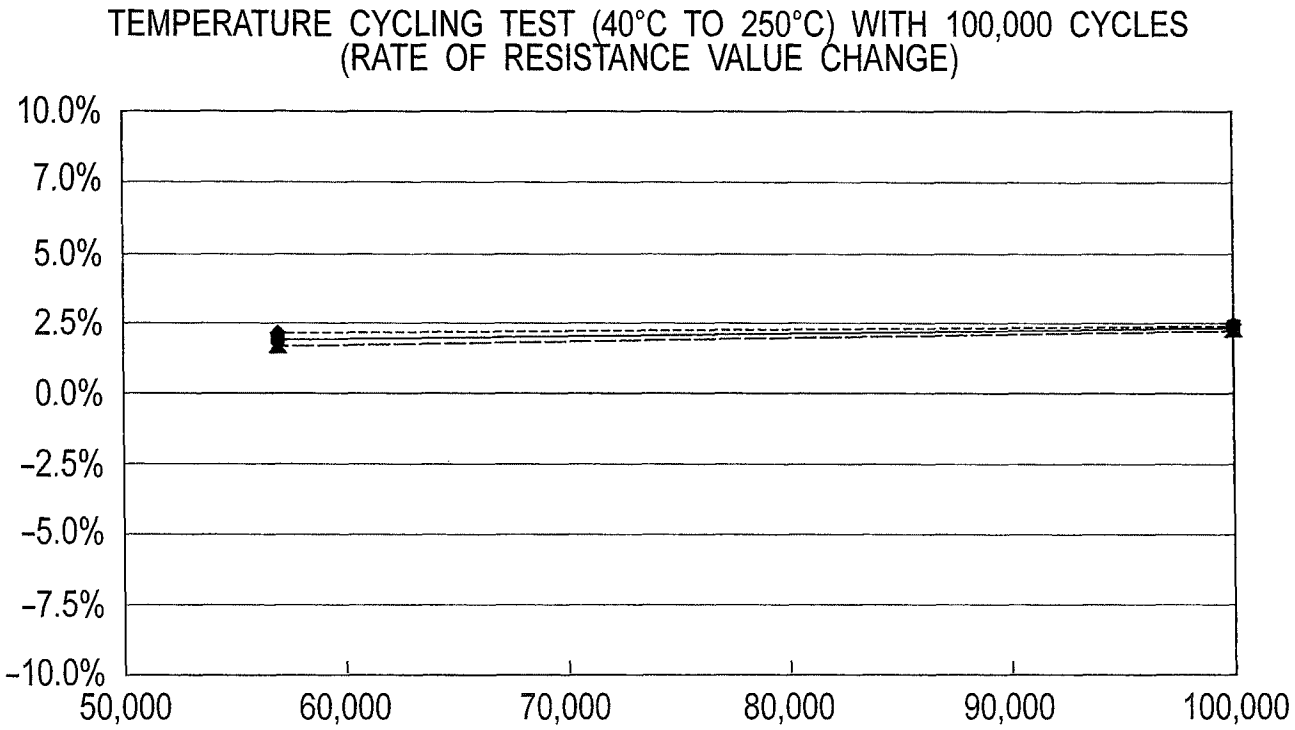
FIG. 9 is a graph illustrating a resistance value change in a temperature cycling test of 40° C. to 250° C., which represents an effect of the present invention.

Next, with reference to FIGS. 7 to 9, description is provided for evaluation results of a thin-film thermistor element according to the present invention which was actually fabricated in the method of the aforementioned embodiment.

The thin-film thermistor elements of a present example were fabricated.

These examples were subjected to a heat resistance test at 250° C. to measure an electric resistance value and a B-value thereof. Moreover, the electric resistance value after 100,000 cycles of a temperature cycle of 40° C. to 250° C. was measured and evaluated.

As seen from the above evaluation results, change rates of the electric resistance value and the B-value of the thin-film thermistor elements of the present examples even after the endurance tests were made much lower than those of conventional elements.

Here, FIGS. 7 to 9 present the evaluation results of the thin-film thermistor elements of the present examples.

Figure 10:
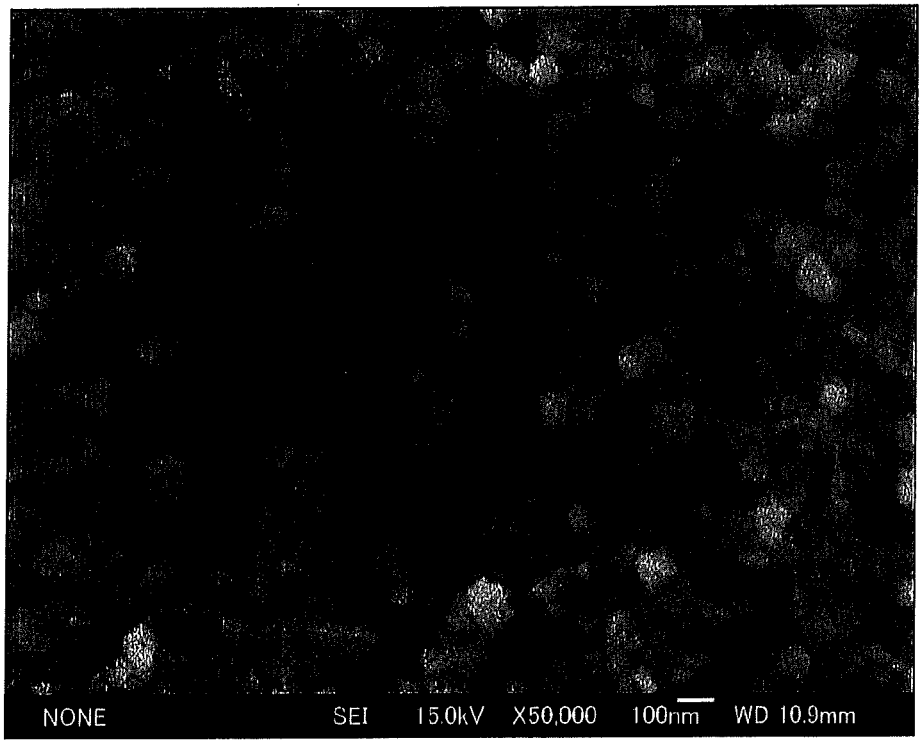
FIG. 10 is an electron microscopic photograph of a thin-film thermistor element after heat treatment, which represents an effect of the present invention.

FIG. 10 presents an electron microscopic observation of a platinum film after heat treatment. From this photograph, the platinum is found crystallized in grains.

As illustrated in FIG. 11, a sharp peak indicating a crystallized state is detected from the heat-treated electrode layer and therefore the electrode layer is found crystallized.

The present invention is not limited to the foregoing embodiments, but may be appropriately modified and implemented in any other mode.

INDUSTRIAL APPLICABILITY

According to the thin-film thermistor element and the method of manufacturing the thin-film thermistor element of the present invention, it is possible to obtain a sufficient adhesive strength between the thermistor thin film and the electrodes while maintaining an adhesive strength between the base substance and the electrodes.

The invention claimed is:

1. A thin-film thermistor element comprising:

a base substance; a thermistor thin film formed on the base substance; and at least one pair of electrodes formed on, under or inside the thermistor thin film, wherein the one pair of electrodes each include an electrode layer made of platinum, an alloy thereof or the like, and the electrode layer is in a crystalline state of crystal with <111> orientation only, and crystalline comprising at least one of oxygen and nitrogen.

2. The thin-film thermistor element according to claim 1, wherein the electrode layer is in a crystalline state of granular crystal with <111> orientation, and contains at least one of oxygen and nitrogen.

3. The thin-film thermistor element according to claim 2, wherein a content of the at least one of oxygen and nitrogen in the electrode layer is from 0.01% by weight to 4.9% by weight, both inclusive.

4. The thin-film thermistor element according to claim 1, wherein the electrode layer is in a crystalline state of columnar crystal with <111> orientation, and contains at least one of oxygen and nitrogen.

5. The thin-film thermistor element according to claim 1, wherein the electrode layer is in a crystalline state of granular crystal and columnar crystal with <111> orientation, and contains at least one of oxygen and nitrogen.

6. A method of manufacturing a thin-film thermistor element for forming a pair of electrodes by patterning on, under or inside a thermistor thin film formed on a base substance, the method comprising:

a first step comprising depositing an electrode layer;

a second step comprising forming at least one pair of electrodes by patterning; and a third step comprising heat-treating the electrode layer to turn the electrode layer into a crystalline state;

wherein the electrode layer is in a crystalline state of crystal with <111> orientation only, and contains at least one of oxygen and nitrogen.

7. The method of manufacturing a thin-film thermistor element according to claim 6, wherein the first step includes depositing the electrode layer with at least one of oxygen and nitrogen added, the heat treatment process in the third step turns the electrode layer into the crystalline state of granular crystal with <111> orientation.

8. The method of manufacturing a thin-film thermistor element according to claim 7, wherein a content of the at least one of oxygen and nitrogen in the electrode layer is from 0.01% by weight to 4.9% by weight, both inclusive.

9. The method of manufacturing a thin-film thermistor element according to claim 6, wherein the first step includes depositing the electrode layer with at least one of oxygen and nitrogen added, the heat treatment process in the third step turns the electrode layer into the crystalline state of columnar crystal with <111> orientation.

10. The method of manufacturing a thin-film thermistor element according to claim 6, wherein the first step includes depositing the electrode layer with at least one of oxygen and nitrogen added, the heat treatment process in the third step turns the electrode layer into the crystalline state of granular crystal and columnar crystal with <111> orientation.

* * * * *